US005136851A

United States Patent [19]

Kotaka

[11] Patent Number: 5,136,851

[45] Date of Patent: Aug. 11, 1992

[54] HELIUM GAS COMPRESSING APPARATUS

[75] Inventor: Hirofumi Kotaka, Narashino, Japan

[73] Assignee: Seiko Seiki Kabushiki Kaisha, Chiba, Japan

[21] Appl. No.: 612,863

[22] Filed: Nov. 14, 1990

[30] Foreign Application Priority Data

Nov. 14, 1989 [JP] Japan ..... 1-295256
Jul. 5, 1990 [JP] Japan ..... 2-72191[U]

[51] Int. Cl.[5] ..... F17C 5/06; F17C 13/02; F25B 9/00; F25B 41/04

[52] U.S. Cl. ..... 62/6; 62/84; 62/468; 62/473

[58] Field of Search ..... 62/6, 84, 468, 473

[56] References Cited

U.S. PATENT DOCUMENTS 2,867,098 1/1959 Kocher ..... 62/473
4,462,219 7/1984 Iwata .
4,557,115 12/1985 Nakamura ..... 62/473 X
4,693,736 9/1987 Klusmier ..... 62/468 X
4,718,442 12/1988 Nicoll .
4,799,359 1/1989 Nicoll ..... 62/468 X
4,949,546 8/1990 Klusmier et al. .

FOREIGN PATENT DOCUMENTS

3028217A1 2/1982 Fed. Rep. of Germany .

*Primary Examiner*—Albert J. Makay
*Assistant Examiner*—Christopher B. Kilner
*Attorney, Agent, or Firm*—Spensley Horn Jubas & Lubitz

[57] ABSTRACT

A helium gas compressing apparatus constructed in such as manner that: an oil separator in a high-pressure gas passage is connected to a low-pressure gas passage; and oil return path having first and second branch paths is provided between the high- and low-pressure gas passages; a capillary tube is installed in one of the two branch paths; and an adjustment valve is installed in the other branch path to adjust the pressure difference between the supply gas in the high-pressure gas passage and the return gas in the low-pressure gas passage. Because of this construction, the adjustment valve can be manipulated from outside to make fine adjustments on the pressure difference or change it to a desired value with ease even during operation of the apparatus, thereby adjusting the refrigerating capability of a helium refrigerating machine connected to the apparatus and the power consumption of the helium gas compressing apparatus.

6 Claims, 5 Drawing Sheets

FIG. 3

| PRESSURE / OPENING OF ADJUST VALVE | EXAMPLES OF PRESSURE ADJUSTMENT [kg/cm²G] | | | CHARACTERISTICS DEPENDING ON PRESSURE DIFFERENCE | | POWER CONSUMPTION DEPENDING ON PRESSURE DIFFERENCE |
|---|---|---|---|---|---|---|
| | SUPPLY GAS PRESSURE | RETURN GAS PRESSURE | PRESSURE DIFFERENCE | REFRIGERATNG CAPABILITY | IMPACTS AND VIBRATIONS | |
| FULL CLOSE | 17.0 | 4.0 | 13.0 | HIGH | HIGH | HIGH |
| | 16.5 | 5.0 | 11.5 | | | |
| | 16.0 | 6.0 | 10.0 | | | |
| | → | → | → | → | → | → |
| OPEN | | | | LOW | LOW | LOW |

HELIUM GAS COMPRESSING APPARATUS

BACKGROUND OF THE INVENTION

1. Field of the Invention

The present invention relates to a helium gas compressing apparatus used in a helium refrigerating machine and more particularly to a helium gas compressing apparatus which is capable of adjusting the pressure difference between gas supplied to the helium refrigerating machine and gas exiting, or returning, therefrom.

2. Description of the Prior Art

An example of a conventional helium gas compressing apparatus is shown in FIG. 2 and generally has a compressor 1 for compressing helium gas. The compressor 1 has a low-pressure suction side 1*a* connected to a low-pressure discharge side 3*a* of a helium refrigerating machine 3 via a low-pressure gas passage 2 while a high-pressure delivery side 1*b* of the compressor 1 is connected to a high-pressure supply side 3*b* of the helium refrigerating machine 3 through a high-pressure gas passage 4.

In the high-pressure gas passage 4 is installed an oil separator 5, which is connected to the low-pressure gas passage 2 via an oil return path 7.

Further, between the low-pressure gas passage 2 and the high-pressure gas passage 4 are provided two other paths: a path 9 including a pressure retaining valve 8; and a path 11 including a solenoid valve 10. The pressure retaining valve 8 is intended to determine the pressure difference (or braking pressure) between the high pressure in the high-pressure gas passage 4 and the low pressure in the low-pressure gas passage 2. That is, the pressure difference is determined by a preset force of a spring installed in the pressure retaining valve 8. A portion of the gas in the high-pressure gas passage 4 can flow into the low-pressure gas passage 2 through the path 9 incorporating the pressure retaining valve 8 to keep this pressure difference constant.

The path 11 in which the solenoid valve 10 is installed works as follows. Immediately after the helium gas compressing apparatus stops, the solenoid valve 10 is switched from a closed to an open state to increase the pressure at the low-pressure discharge side 3*a* of the helium refrigerating machine 3 so that oil in the oil separator 5 and in the compressor 1 will not flow back to the helium refrigerating machine 3 through the low-pressure gas passage 2. Oil backflow is also prevented by a check valve 12.

A pressure switch 13 monitors the pressures in the low-pressure suction side 1*a* and the high-pressure delivery side 1*b* of the compressor 1. A thermostat 14 monitors the temperature of the gas in high-pressure gas passage 4. Pressure gauges 15 and 16 monitor the pressures in the high-pressure gas passage 4 and the low-pressure gas passage 2, respectively. A safety valve 17 is designed to release excess gas from the high-pressure gas passage 4 in times of emergency.

In the above-described helium gas compressing apparatus, helium gas is introduced into the low-pressure gas passage 2 through a charge valve 18.

Other elements shown in FIG. 2 will be identified in the following description of the operation of the illustrated conventional helium gas compressing apparatus.

With this helium gas compressing apparatus, the helium gas in the form of an oil mist compressed by the compressor 1 to a high pressure is supplied from the high-pressure delivery side lb of the compressor 1 into the high-pressure gas passage 4 and is then cooled by a cooling fan 19 down to a normal temperature. The cooled gas now passes through the compressor 1 to cool the oil therein and is then cooled again by the fan to the normal temperature on its way to the oil separator 5, which is installed in the high-pressure gas passage 4.

In the oil separator 5, the high-pressure helium gas in the form of an oil mist is separated into high-pressure helium gas and oil. The high-pressure helium gas thus extracted by the oil separator 5 is fed through the high-pressure gas passage 4 to an oil adsorber 20 where residual oil contained in the gas is further removed before being supplied to the high-pressure supply side 3*b* of the helium refrigerating machine 3. The high-pressure helium gas supplied to the refrigerating machine 3 will hereafter be referred to as supply gas and the helium gas returned to the low-pressure gas passage 2 will hereafter be referred to as return gas.

The supply gas fed to the helium refrigerating machine 3 is returned from the low-pressure discharge side 3*a* of the refrigerating machine 3, as return gas, into the low-pressure gas passage 2. The return gas flows through the check valve 12 and a strainer 21 to the low-pressure suction side 1*a* of the compressor 1 where it is compressed again into a high-pressure helium gas in the form of oil mist.

The oil separated by the oil separator 5 is passed through a capillary tube 6 to meter or restrict the oil flow to a predetermined amount, which is then fed to the low-pressure gas passage 2, from which the oil flows through the strainer 21 to the low-pressure suction side 1*a* of the compressor 1 and into the compressor 1.

The pressure retaining valve 8 that determines the pressure difference (braking pressure) between the supply gas in the high-pressure gas passage 4 and the return gas in the low-pressure gas passage 2 operates to allow a part of the high-pressure gas in the high-pressure gas passage 4 to flow into the low-pressure gas passage 2 so that the pressure difference determined based on the spring force of the spring installed in the pressure retaining valve 8 is maintained.

With the conventional helium gas compressing apparatus described above, however, the pressure retaining valve 8, which determines the pressure difference (braking pressure) between the supply gas in the high-pressure gas passage 4 and the return gas in the low-pressure gas passage 2, is operated under control of the spring force of the preset spring installed therein, so that there is no possibility of adjusting the pressure difference. Hence the pressure difference is fixed and it is structurally impossible to change the preset pressure difference from outside.

Thus, the following problem arises with the conventional helium gas compressing apparatus of the above construction. In cannot meet such user demands as making in-service adjustments on the pressure difference in the helium gas compressing apparatus according to power consumption of the apparatus and to specifications involving the refrigerating capability of the helium refrigerating machine. Both the power consumption and the refrigerating capability depend on the magnitude of this pressure difference. Because of the inability to make fine adjustments on this pressure difference, a single apparatus cannot meet varying specifications and power consumptions. In other words, two or more helium gas compressing apparatuses are required to accommodate such demands.

With a gas-driven helium refrigerating machine, in particular, vibrations and impacts occur depending on the magnitude of the pressure difference, or braking pressure. It has therefore been an urgent task to develop a helium gas compressing apparatus capable of making fine adjustment on the pressure difference to alleviate the vibrations and impacts produced during operation.

SUMMARY OF THE INVENTION

It is therefore an object of the present invention to provide a helium gas compressing apparatus capable of performing adjustment on the pressure difference, or braking pressure.

It is another object of the present invention to provide a helium gas compressing apparatus with a control valve to accelerate the refrigerating period, the time from the start of operation to the moment when a predetermined cooling temperature is attained.

It is a further object of the present invention to provide a helium gas compressing apparatus with an automatic control valve in order to rapidly cool a refrigerating machine to a predetermined temperature in a short time, and automatically control operating conditions to prevent excessive cooling and reduce vibrations, noise and operating power.

To achieve the above objectives, the helium gas compressing apparatus of this invention comprises: a compressor for compressing a helium gas; a low-pressure gas passage connecting a low-pressure suction side of the compressor and a low-pressure discharge side of a helium refrigerating machine; a high-pressure gas passage connecting a high-pressure delivery side of the compressor and a high-pressure supply side of the helium refrigerating machine; an oil separator installed in the high-pressure gas passage; a pressure retaining valve installed in a path between the high-pressure gas passage and the low-pressure gas passage to determine the difference in pressure between the gas in the low-pressure gas passage and the gas in the high-pressure gas passage; an oil return path connecting the oil separator and the low-pressure gas passage, the oil return path having a first branch path and a second branch path; a capillary tube installed in one of the two branch paths of the oil return path; and an adjustment valve installed in the other branch path of the oil return path to adjust the pressure difference between supply gas in the high-pressure gas passage and return gas in the low-pressure gas passage.

This invention further comprises an open-close control valve connected in series with the adjustment valve.

In further accordance with the invention, the adjustment valve of the above-described apparatus is an automatic adjustment valve controlled by a programmed controller.

In the helium gas compressing apparatus with the above mentioned open-close control valve, immediately after the apparatus is started it is possible to cool the refrigerating machine rapidly at the maximum pressure difference, with only the pressure retaining valve in operation, by closing the open-close control valve connected in series with the adjustment valve. When the temperature has lowered to a specified cooling temperature, the open-close control valve is fully opened to bring the preset adjustment valve into operation, thus allowing the pressure difference to be promptly changed to the minimum required value.

In the helium gas compressing apparatus with the above mentioned automatic adjustment valve, immediately after the apparatus is started a sensor detects that the cooling section of the helium refrigerating machine has not reached the predetermined cooling temperature. According to the detection signal produced by this sensor, the programmed controller controls the automatic adjustment valve to the fully closed state, rapidly cooling the refrigerating machine at the maximum pressure difference with only the pressure retaining valve in operation. When the sensor detects that the temperature of the cooling section of the helium refrigerating machine has reached the specified temperature, the programmed controller, responsive to the detection signal from the sensor, opens the automatic adjustment valve to a preset opening state. This combined operation of the automatic adjustment valve and the pressure retaining valve enables an immediate change of the pressure difference in the helium gas compressing apparatus to the minimum required value.

BRIEF DESCRIPTION OF THE DRAWINGS

FIG. 3 is a table showing the power consumption of a helium gas compressing apparatus and the specifications of a helium refrigerating machine, both the power consumption and specifications being dependent on the open-close control valve.

DESCRIPTION OF THE PREFERRED EMBODIMENTS

One preferred embodiment of a helium gas compressing apparatus according to this invention will be described in detail with reference to FIG. 1.

Figure 1:
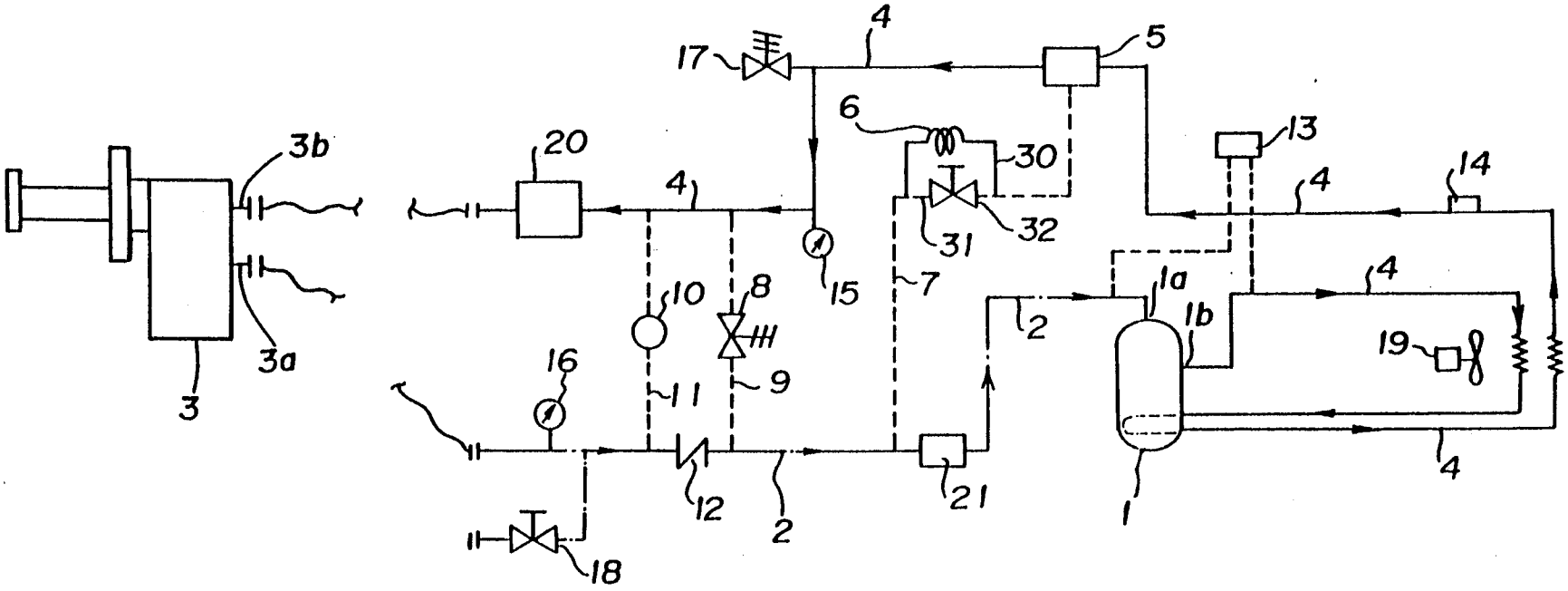
FIG. 1 is a schematic system diagram showing a helium gas compressing apparatus according to one preferred embodiment of the invention.
Figure 2:
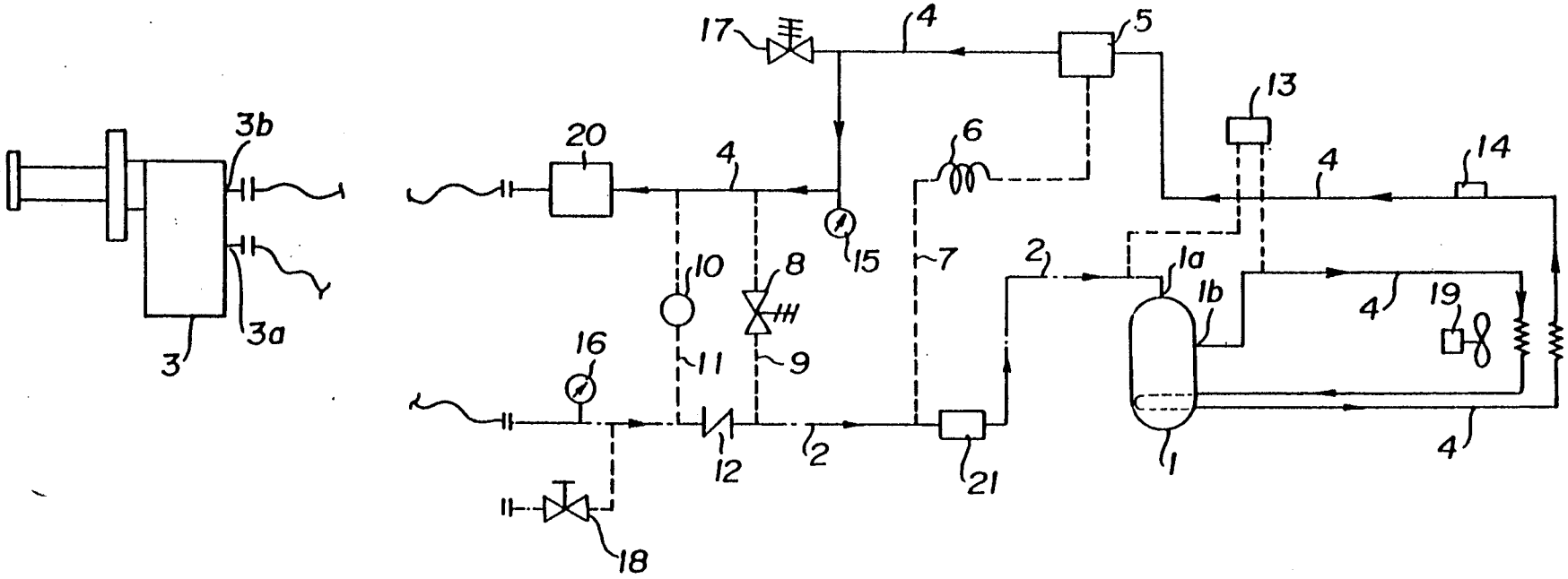
FIG. 2 PRIOR ART
FIG. 2 is a schematic diagram similar to that of FIG. 1 showing a conventional helium gas compressing apparatus, which has already been described.

In FIG. 1, like reference numerals are assigned to components that are identical to those of the conventional apparatus of FIG. 2, and description thereof is omitted.

In the helium gas compressing apparatus of this invention, as shown in FIG. 1, a compressor 1 for compressing a helium gas is connected to one end of a low-pressure gas passage 2 and to one end of a high-pressure gas passage 4 in which an oil separator 5 is installed. The other ends of these passages 2, 4 are connected to a helium refrigerating machine 3. Connected between the two passages 2 and 4 are a path 9 in which a pressure retaining valve 8 is installed and a path 11 in which a solenoid valve 10 is installed. The above construction is the same as the conventional apparatus and its detailed description omitted.

Now, one configuration characteristic of this invention will be described. In the helium gas compressing apparatus according to this invention, the oil separator 5 and the low-pressure gas passage 2 are interconnected through oil return path 7. The oil separated by oil separator 5 installed in high-pressure gas passage 4 and a part of the supply gas in the high-pressure gas passage 4 are led into the low-pressure gas passage 2 through capillary tube 6 and an adjustment valve 32 that are installed in a first branch path 30 and a second branch path 31, respectively, the first and second branch paths 30, 31 forming oil return path 7. The capillary tube 6, adjustment valve 32 and pressure retaining valve 8 work in combination to determine the pressure difference between the supply gas in the high-pressure gas passage 4 and the return gas in the low-pressure gas passage 2, with the pressure difference being adjusted by the opening and closing of adjustment valve 32.

The adjustment valve 32 is intended to adjust the pressure difference between the supply gas in the high-pressure gas passage 4 and the return gas in the low-pressure gas passage 2.

Now, the operation of this portion of apparatus according to the invention will be described. The oil separated by oil separator 5 arranged in high-pressure gas passage 4 and a part of the supply gas are fed to the low-pressure gas passage 2 via the oil return path 7, which is composed of branch paths 30, 31 that have the capillary tube 6 and the adjustment valve 32, respectively. This reduces the pressure in the high-pressure gas passage 4 and increases the pressure in the low-pressure gas passage 2 until the pressure difference between the two passages settles to a specific value, as shown in FIG. 3, which is controlled by the opening of the adjustment valve 32.

When the adjustment valve 32 is fully closed, only a specified amount of oil is supplied to the low-pressure gas passage 2 through the capillary tube 6 in the first branch path 30 of the oil return path 7.

With the adjustment valve 32 fully closed, the pressure difference is determined by the pressure retaining valve 8 and the capillary tube 6. FIG. 3 shows that the pressure differences become smaller as the adjustment valve 3 is gradually opened from its fully closed state.

In the helium gas compressing apparatus described above, oil separator 5 in high-pressure gas passage 4 is connected to low-pressure gas passage 2; the oil return path 7 which consists of the first and second branch paths 30 and 31 is connected between the high-pressure passage 4 and low-pressure passage 2; the capillary tube 6 is installed in the first branch path 30 and the adjustment valve 32 is installed in the second branch path 31 to adjust the pressure difference between the supply gas in high-pressure gas passage 4 and the return gas in low-pressure gas passage 2. Because of this configuration, the adjustment valve 32 can be manipulated from outside to a desired opening state so that the pressure difference between the supply gas in the high-pressure gas passage 4 and the return gas in the low-pressure gas passage 2 can be adjusted according to the opening of the adjustment valve 32. This allows an operator to make fine adjustments from outside on the pressure difference or change it to a desired value with ease even during operation of the apparatus, thereby adjusting the refrigerating capability of the helium refrigerating machine and the power consumption of the helium gas compressing apparatus, both of which depend on the magnitude of the pressure difference, or braking pressure.

When applied to a gas-driven helium refrigerating machine, the helium gas compressing apparatus of this invention is able to minimize impacts and vibrations produced in the refrigerating machine, by slightly changing the pressure difference to reduce the operating power of the refrigerating machine.

While this embodiment has adjustment valve 32 installed in second branch path 31, it is possible to arrange adjustment valve 32 in first branch path 30 and capillary tube 6 in second branch path 31. Adjustment valve 32 may also be installed in a parallel branch of the path, connected between the high- and low-pressure gas passages, that contains pressure retaining valve 8, or in a parallel branch of the path containing solenoid valve 10.

Other embodiments will be described with reference to FIGS. 4 and 5.

Figure 4:
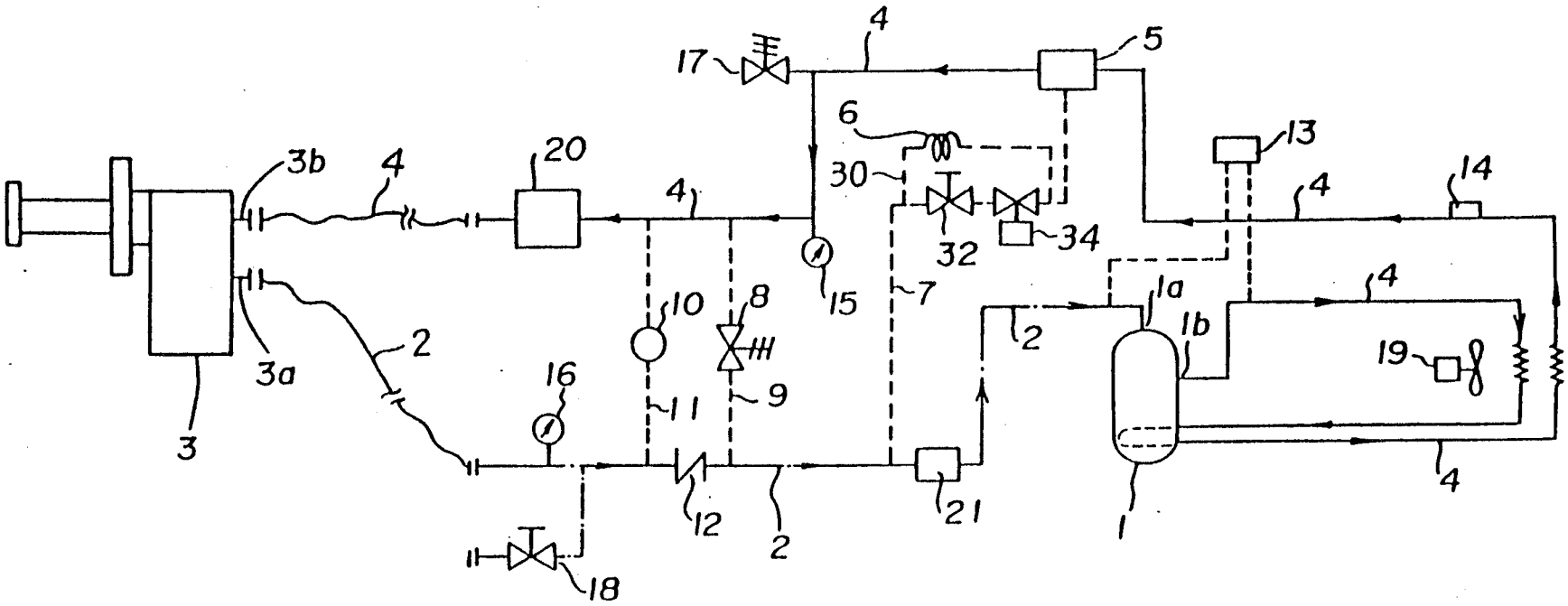
FIG. 4 is a schematic diagram similar to that of FIG. 1 showing an embodiment of a helium gas compressing apparatus with an open-close control valve according to the invention.

In FIG. 4, oil return path 7 is further provided with a solenoid operated valve 34 (open-close control valve) connected in series with adjustment valve 32 and, together with valve 32, in parallel with capillary tube 6. The solenoid operated valve 34 is driven by an output signal from a timer or a temperature sensor that monitors the temperature of the cooling section of the refrigerating machine. (The timer and the temperature sensor can be constructed in a conventional manner and are not shown.)

With the helium gas compressing apparatus according to this embodiment of the invention, immediately after the apparatus is started the helium refrigerating machine 3 can be quickly cooled at the maximum pressure difference, with only the pressure retaining valve 8 in operation, by closing solenoid operated valve 34 serially connected with the adjustment valve 32. When a specified cooling temperature is reached, solenoid operated valve 34 is fully opened automatically by an output from the timer or the temperature sensor to activate preset adjustment valve 32. This combined operation of the pressure retaining valve 8 and the adjustment valve 32 can cause an immediate change in the pressure difference to a minimum required value.

Therefore, it is not necessary to manually open adjustment valve 32 during operation each time the helium gas compressing apparatus is activated. The adjustment valve 32, which is preset to an optimum opening state, is maintained at that opening at all times, so that it is possible to realize the optimum pressure difference as soon as the refrigerating machine 3 reaches the specified temperature. This in turn prevents excessive cooling of the refrigerating machine 3 below that temperature and reduces vibrations, noise and operating power, significantly improving the operability of the helium gas compressing apparatus.

While in the above embodiment capillary tube 6 is installed in bypass path 30, and adjustment valve 32 and solenoid operated valve 34 are installed in oil return path 7, the same result can also be obtained if capillary tube 6 is put in oil return path 7, and adjustment valve 32 and solenoid operated valve 34 are arranged, still in parallel with tube 6, in bypass path 30.

Although the embodiment of FIG. 4 has adjustment valve 32 and solenoid operated valve 34 connected in parallel with the capillary tube 6, it is possible to form a bypass path in the gas return path 9 and put both valves 32 and 34 in that bypass path in parallel with the pressure retaining valve 8. Alternatively, gas return path 11 may be provided with a bypass path in which valves 32 and 34 are installed so that they are connected in parallel with the solenoid valve 10.

Figure 5:
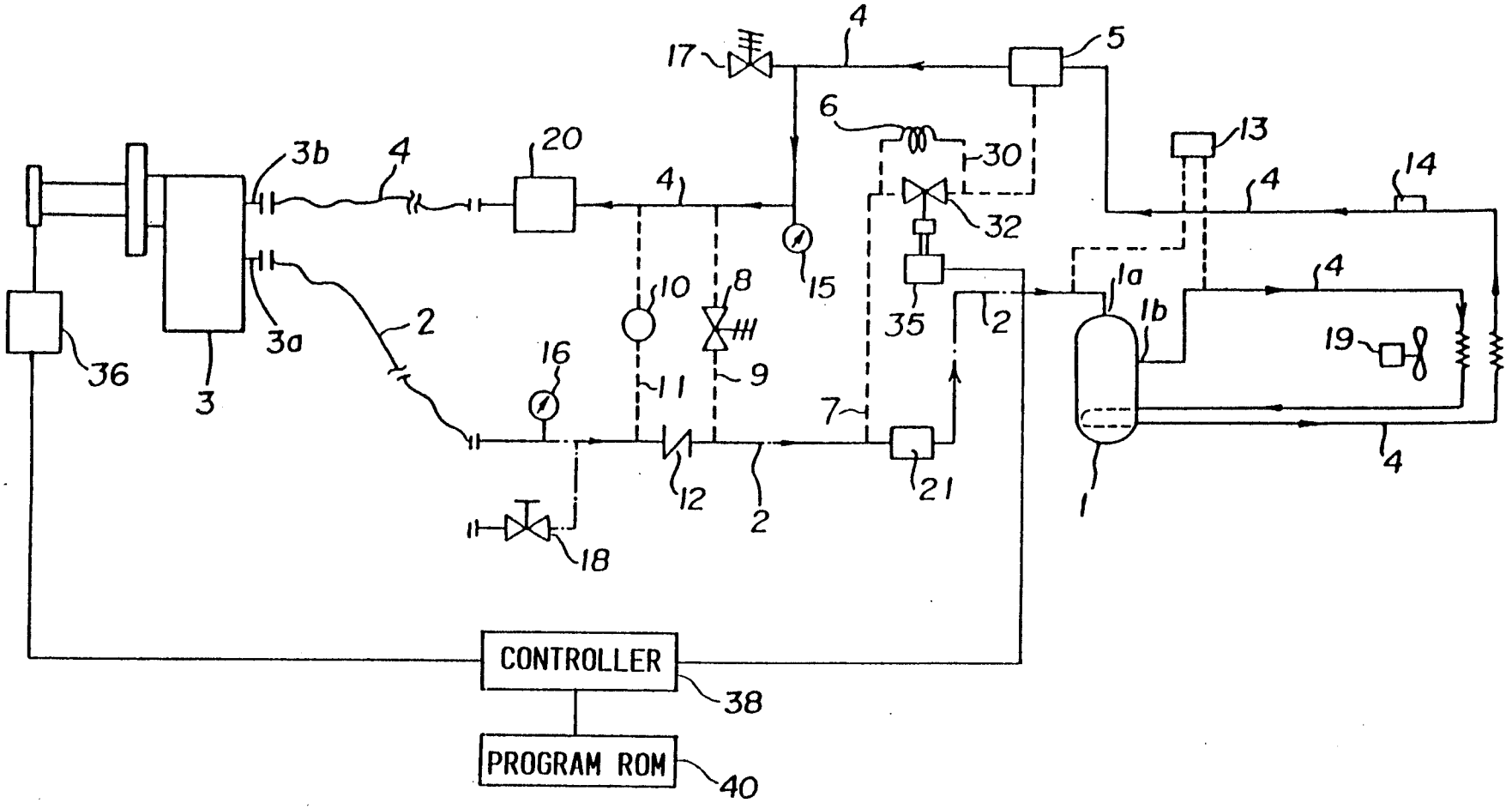
FIG. 5 is a schematic diagram similar to that of FIG. 1 showing another embodiment of a helium gas compressing apparatus with an automatic adjustment valve.

In FIG. 5, oil separator 5 is connected to a low-pressure gas passage 2 via oil return path 7 having a parallel bypass path 30. Capillary tube 6 is installed in the bypass path 30, and a needle valve 32 (automatic adjustment valve) which is driven by a step-motor 35 is connected in the oil return path 7 in parallel with capillary tube 6. The cooling section of the helium gas refrigerating machine 3 is fitted with a sensor 36 that detects the temperature of the cooling section. A detection signal output from sensor 36 is fed to a controller 38 which, based on the detection signal and under control of a program in a ROM 40, controls, by operation of step-motor 35, the graduated opening of the needle valve 32.

In the helium gas compressing apparatus of the above construction, immediately after the apparatus is started, sensor 36 detects that the cooling section of helium refrigerating machine 3 has not reached the predetermined cooling temperature. Based on the detection signal of sensor 36, controller 38 controls the step-motor 35 to fully close needle valve 32. As a result; the helium gas compressing apparatus can rapidly cool the helium refrigerating machine 3 at the maximum pressure difference with only the pressure retaining valve 8 in operation. Then, when sensor 36 detects that the cooling section of the helium refrigerating machine 3 has been cooled to the predetermined cooling temperature, controller 38, according to the detection signal from sensor 36, controls step-motor 35 to open needle valve 32 by a specified amount, which was preset in ROM 40. The combined operation of needle valve 32 and pressure retaining valve 8 now enables the pressure difference to be immediately changed to the minimum required value.

With this embodiment, since needle valve 32 can automatically be operated by controller 38, there is no need to manually operate adjustment valve 32 during operation each time the apparatus is energized as with the conventional apparatus. Further, by storing the desired opening setting of needle valve 32 in ROM 40 beforehand, it is always possible to instantly open needle valve 32 to the optimum degree, allowing the pressure difference to be immediately set to the optimum value as soon as helium refrigerating machine 3 has reached the specified temperature. This in turn prevents excessive cooling of helium refrigerating machine 3 below that temperature and also reduces vibrations, noise and operating power, substantially improving the operability of the helium gas compressing apparatus.

While in the above embodiment capillary tube 6 is provided in bypass path 30 and needle valve 32, driven by step-motor 35, is installed in oil return path 7, the same result can also be obtained if capillary tube 6 is arranged in oil return path 7 and needle valve 32 in bypass path 30.

Furthermore, although in the above embodiment needle valve 32 driven by step-motor 35 is provided in parallel with capillary tube 6, it is possible to form a bypass path around valve 8 in gas return path 9 and arrange needle valve 32 in the bypass path in parallel with the pressure retaining valve 8 or to form a bypass path around valve 10 in gas return path 11 and install needle valve 32 in that bypass path in parallel with solenoid valve 10.

As mentioned above, the helium gas compressing apparatus of this invention is constructed in such a manner that the oil separator in the high-pressure gas passage is connected to the low-pressure gas passage; that the oil return path having the first and second branch paths is provided between the high- and low-pressure gas passages; that the capillary tube is installed in one of the two branch paths; and that the adjustment valve is installed in the other branch path to adjust the pressure difference between the supply gas in the high-pressure gas passage and the return gas in the low-pressure gas passage. Because of this construction, the adjustment valve can be manipulated from outside to make fine adjustments on the pressure difference or change it to a desired value even during operation of the apparatus, thereby adjusting the refrigerating capability of the helium refrigerating machine and the power consumption of the helium gas compressing apparatus. This in turn makes possible a wide range of refrigerating capability and power consumption.

Especially when applied to a gas-driven helium refrigerating machine, the helium gas compressing apparatus of this invention can meet the requirements for reducing impacts and vibrations produced in the refrigerating machine, by slightly adjusting the pressure difference to reduce the operating power of the refrigerating machine. The apparatus therefore has the advantage of an expanded range of capability.

Furthermore, this invention has the following advantages. Immediately after startup of the apparatus, the pressure difference is set to the maximum to cool the refrigerating machine to a predetermined temperature in the shortest possible time. Once the refrigerating machine has been cooled to the predetermined temperature, the pressure difference is immediately changed to the minimum required value to prevent excessive cooling below that temperature and also reduce vibrations, noise and operating power. This results in a substantial improvement in the operability of the helium gas compressing apparatus.

This application relates to subject matter disclosed in Japanese applications Nos. 1-295256 filed Nov. 14, 1989 and U2-72191, filed Jul. 5, 1990, the disclosure of which is incorporated herein by reference.

While the description above referes to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A helium gas compressing apparatus for supplying compressed gas to a helium refrigerating machine, the machine having a gas inlet and a gas outlet, said apparatus comprising:

a compressor for compressing a helium gas, said compressor having a low-pressure suction inlet and a high-pressure delivery outlet;

means defining a low-pressure gas passage for connecting said low-pressure suction inlet of said compressor to the gas outlet of the helium refrigerating machine such that during operation of said apparatus gas at a low gas pressure is present in said low-pressure gas passage;

means defining a high-pressure gas passage for connecting said high-pressure delivery outlet of said compressor to the gas inlet of the helium refrigerating machine such that during operation of said apparatus gas at a high gas pressure is present in said high-pressure gas passage and there is a pressure difference between the high gas pressure and the low gas pressure;

an oil separator installed in said high-pressure gas passage;

a pressure retaining valve connected between said high-pressure gas passage and said low-pressure gas passage and operative to influence the pressure difference between the low gas pressure in said low-pressure gas passage and the high gas pressure in said high-pressure gas passage;

an oil return path connecting said oil separator to said low-pressure gas passage;

a capillary tube installed in said oil return path;

a controllable adjustment valve connected between said high-pressure gas passage and said low-pressure gas passage to controllably adjust the pressure difference between the gas pressure in said low-pressure gas passage and the gas pressure in said high-pressure gas passage; and an open-close control valve disposed in series with said adjustment valve.

2. The helium gas compressing apparatus in accordance with claim 1, wherein said adjustment valve is installed in a branch path disposed in parallel with said capillary tube.

3. The helium gas compressing apparatus in accordance with claim 1, wherein said adjustment valve is installed in a branch path disposed in parallel with said pressure retaining valve.

4. A helium gas compressing apparatus, for supplying compressed gas to a helium refrigerating machine, the machine having a gas inlet and a gas outlet, said apparatus comprising:

a compressor for compressing a helium gas, said compressor having a low-pressure suction inlet and a high-pressure delivery outlet;

means defining a low-pressure gas passage for connecting said low-pressure suction inlet of said compressor to the gas outlet of the helium refrigerating machine such that during operation of said apparatus gas at a low gas pressure is present in said low-pressure gas passage;

means defining a high-pressure gas passage for connecting said high-pressure delivery outlet of said compressor to the gas inlet of the helium refrigerating machine such that during operation of said apparatus gas at a high gas pressure is present in said high-pressure gas passage and there is a pressure difference between the high gas pressure and the low gas pressure;

an oil separator installed in said high-pressure gas passage;

a pressure retaining valve connected between said high-pressure gas passage and said low-pressure gas passage and operative to influence the pressure difference between the low gas pressure in said low-pressure gas passage and the high gas pressure in said high-pressure gas passage;

an oil return path connecting said oil separator to said low-pressure gas passage;

a capillary tube installed in said oil return path;

a controllable adjustment valve connected between said high-pressure gas passage and said low-pressure gas passage to controllably adjust the pressure difference between the gas pressure in said low-pressure gas passage and the gas pressure in said high-pressure gas passage; and an open-close control valve disposed in series with said adjustment valve wherein: the helium refrigerating machine has a cooling section; and adjustment valve is an automatically controllable adjustment valve; and said apparatus further comprises sensor means for detecting the temperature of the cooling section of the helium refrigerating machine, and control means connected for controlling said adjustment valve in response to a signal detected by said sensor means.

5. The helium gas compressing apparatus in accordance with claim 4 wherein said adjustment valve has a preset open position.

6. The helium gas compressing apparatus in accordance with claim 4 wherein said adjustment valve is progressively operable between a fully closed position and a fully open position and the position of said valve is controlled in response to the signal detected by said sensor means.

* * * * *